US007585201B2

(12) United States Patent
Kanai et al.

(10) Patent No.: US 7,585,201 B2
(45) Date of Patent: Sep. 8, 2009

(54) WATER JET PROCESSING METHOD

(75) Inventors: Shigekazu Kanai, Ota-Ku (JP); Satoshi Hanajima, Ota-ku (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 12/126,370

(22) Filed: May 23, 2008

(65) Prior Publication Data

US 2009/0013839 A1 Jan. 15, 2009

(30) Foreign Application Priority Data

Jun. 14, 2007 (JP) ..... 2007-157466

(51) Int. Cl.
*B24C 1/00* (2006.01)

(52) U.S. Cl. ..... 451/2; 451/40; 451/57

(58) Field of Classification Search ..... 451/38, 451/39, 40, 57, 2, 3, 75, 76, 41; 83/53, 177
See application file for complete search history.

(56) References Cited

U.S. PATENT DOCUMENTS 3,694,972 A * 10/1972 Emeis ..... 451/38
4,703,591 A * 11/1987 Herrington et al. ..... 451/40
4,893,440 A * 1/1990 Gallant et al. ..... 451/78
6,120,351 A * 9/2000 Zeng ..... 451/28
6,155,245 A * 12/2000 Zanzuri ..... 125/12
7,059,940 B2 * 6/2006 Seo et al. ..... 451/37
7,074,112 B2 * 7/2006 Olsen ..... 451/11
7,419,418 B2 * 9/2008 Alberts et al. ..... 451/2
7,455,568 B2 * 11/2008 Sekiya ..... 451/2

FOREIGN PATENT DOCUMENTS

JP A 5-253843 10/1993

* cited by examiner

*Primary Examiner*—Robert Rose
(74) *Attorney, Agent, or Firm*—Greer, Burns & Crain, Ltd.

(57) ABSTRACT

In a water jet processing method, when a nozzle adapted to emit water jet is moved relatively to a substrate to form a second cut line intersecting a first cut line, the relative travel speed of the nozzle is set to a second speed lower than a first normal speed by about ⅕ to 1/20 at least in a section antero-posterior to the intersection. Delay-inclination of a front edge of the second cut line is eliminated as much as possible to thereby prevent the occurrence of an insufficient processing area.

2 Claims, 8 Drawing Sheets
(2 of 8 Drawing Sheet(s) Filed in Color)

WATER JET PROCESSING METHOD

BACKGROUND OF THE INVENTION

1. Field of the Invention

The present invention relates to water jet processing methods of cutting a platelike workpiece made of a relatively brittler material by producing a jet of high-pressure processing water directed to the workpiece. In particular, the invention relates to such a water jet processing method in the case where cutting lines are intersected with each other.

2. Description of the Related Art

Substrates mounted thereon with e.g. a semiconductor device are frequently made of a brittle material such as glass epoxy, glass composite or the like. The glass epoxy is made by impregnating an epoxy resin into a stack of glass fiber-made fabrics. The glass composite is made by impregnating an epoxy resin into a stack of cut and trimmed glass fibers. Such brittle substrates are obtained by cutting one large material in a lattice pattern. The water jet mentioned above in which high-pressure processing water is jetted to a workpiece is used as a cutting method in some cases. See Japanese Patent Laid-open No. Hei 5-253843.

Referring to FIGS. 6A, 6B and 6C, when a substrate material is cut in a lattice pattern by water jet, there arises a situation as below. A linear cut line (the second cut line) 2*a* is made to orthogonally intersect another linear cut line (the first cut line) 1*a* for cutting, the first cut line having initially been cut to extend in one direction. The substrate is previously formed with predetermined cutting lines each serving as an index for a corresponding cut line.

FIG. 7 illustrates a state where water jet is directed from a traveling nozzle 13 to a substrate 5 to form a second cut line 2*a* toward a first cut line 1*a*, a shaded portion being a cut portion of a material. As shown in the figure, a front edge 2*b* of the second cut line 2*a* against which the water jet collides is formed to have a delay rearward of the advancing direction as it goes toward the back (underside) from the front surface subjected to the jet. In short, "delay-inclination" is occurring. The second cut line 2*a* reaches the first cut line 1*a* while forming such delay-inclination. In that instant, a phenomenon arises in which most pressure of the water jet cutting the material escapes at one burst toward the first cut line 1*a* which is a cavity. This phenomenon causes an insufficient cut area, i.e., insufficient processing area 2*c* under the delay-inclination. This leads to a problem in that projections 9 are formed to narrow the second cut line 2*a* as shown in FIGS. 5A and 8B. The insufficient processing area 2*c* is more liable to occur as the travel speed of the nozzle 13 is higher and the angle θ of the delay-inclination shown in FIG. 7 becomes larger to more increase the degree of the delay-inclination.

At the time when the escape of water jet mentioned above occurs, the first cut line 1*a* and the second cut line 2*a* intersect with each other in a T-shape as shown in FIG. 6B. In order to subsequently form the second cut line 2*a* from such a position, the water jet that has traversed the first cut line 1*a* orthogonally collides against a wall (a portion indicated with reference numeral 8 of FIG. 6B) of the material to be cut therefrom and then the second cut line is made to crisscross intersect the first cut line 1*a*. However, when the collision occurs, the processing water colliding against and bouncing off the wall hits the vicinity of the opening of the already cut second cut line 2*a* with respect to the first cut line 1*a*. Thus, a disadvantage occurs that inadvertent processing is done such as damage to the vicinity of the opening (e.g., a portion surrounded by a broken line of FIG. 8A).

As described above, if cutting is performed by water jet to cause the second cut line to intersect the first cut line, a disadvantage occurs that an insufficient processing area is formed on the underside of the workpiece and in the front of the intersection of the second cut line with the first cut line and the vicinity of the opening to the first cut line is unnecessarily damaged. These disadvantages tend to be more remarkable as the travel speed of the water jet is higher.

SUMMARY OF THE INVENTION

Accordingly, it is an object of the present invention to provide a water jet processing method that can prevent abnormal processing and damage occurring when cut lines are made by water jet to intersect with each other, thereby providing satisfactory products.

In accordance with an aspect of the present invention, there is provided a water jet processing method using a water jet processing machine including: holding means for holding a platelike workpiece on which a first predetermined cutting line and a second predetermined cutting line intersecting the first predetermined cutting line are set; processing water supplying means for supplying high-pressure processing water; a nozzle adapted to emit the processing water supplied from the processing water supply means, to the workpiece held by the holding means; and emission-position moving means for relatively moving the nozzle and the holding means to change a position where the processing water is emitted from the nozzle to the workpiece; wherein while the nozzle and the holding means are relatively moved by the emission-position moving means, the processing water emitted from the nozzle is directed to the workpiece held by the holding means along the first predetermined cutting line and along the second predetermined cutting line to cut the first and second predetermined cutting lines, the water jet processing method comprising: a first cutting step for cutting the first predetermined cutting line to form a first cut line at a relative travel speed between the nozzle and the holding means set to a first speed; and a second cutting step for cutting the second predetermined cutting line to form a second cut line, the second predetermined cutting line being cut in a section anteroposterior to an intersection between the first cut line and the second predetermined cutting line at the relative travel speed set to a second speed lower than the first speed.

Preferably, in the second cutting step relative movement between the nozzle and the holding means is once lowered when water jet enters and cuts the anteroposterior section at the second speed. First, the relative travel speed of the water jet in front of the intersection of the second predetermined cutting line with the first cut line is made lower; therefore, the angle θ of the delay-inclination shown in FIG. 7 is reduced to a near-zero angle. Thus, the escape of the water jet does not occur, which can reduce an insufficient processing area. In addition, the occurrence of the insufficient processing area can be suppressed depending on the travel speed. As a result, the occurrence of the projections 9 shown in FIGS. 8A and 8B can be prevented.

Next, when the second cut line is formed after it has traversed the first cut line, that is, the relative travel speed is lowered when the water jet is moved rearward of (to the leading side of the moving direction) the intersection of the cut lines, the water jet does not collide with the wall of the material to be cut, but slowly hits it to gradually carve the wall, forming the second cut line. Thus, the bounce of the processing water is unlikely to occur. That is to say, it can be prevented that the bounce of the processing water damages the vicinity of the opening of the second cut line to the first cut line.

In the present invention, the relative travel speed of the water jet in the second cut step is made low (lower than the travel speed during the formation of the first cut line) at least in the section or portion anteroposterior to the intersection of the cut lines. The water jet may be moved in the second cutting step at the travel speed (the first speed) equal to the travel speed during the formation of the first cut line other than the above section. In other words, for example, the following operating mode may be applicable. The second cut line is formed at the first speed and the relative travel speed of the water jet is reduced to the second speed immediately anterior to the first cut line. The water jet is relatively moved at the second speed until the second cut line traverses the first cut line, that is, cuts into it in a cross shape. Thereafter, the second speed is again returned to the first speed. The second speed is e.g. about ⅕ to 1/20, preferably, 1/10, of the first speed.

The present invention prevents the existence of the projections 9 shown in FIGS. 8A and 8B. The lower the second speed is, or the more the deceleration point where the first speed is switched to the second speed is spaced from the intersection with the first cut line, the more the size of the projection 9 can be reduced. If these conditions are controlled to conform to the thickness of the workpiece, it is possible not to leave the projections 9 or to bring the size of the projections 9 to an acceptable value or less.

In the present invention, when the water jet to form the second cut line is immediately anterior to the intersection of the cut lines and enters the low-speed travel period, the relative movement of the jet water, i.e., the relative movement of the nozzle and the holding means, may be stopped once. If such operating mode is taken, the inclination angle θ formed at the front edge of the water jet is eliminated immediately anterior to the interval. In other words, the delay-inclination is eliminated and then the water jet is moved to the intersection with the first cut line at a low speed. Consequently, it is more ensured to produce an effect of preventing the occurrence of the insufficient processing area, compared with the case where the water jet is moved at a low speed with the delay-inclination left.

According to the water jet processing method of the present invention, abnormal processing or damage can be prevented that has otherwise been produced when the second cut line is made to intersect the first cut line, thereby producing an effect of providing satisfactory products.

The above and other object, features and advantages of the present invention and the manner of realizing them will become more apparent, and the invention itself will best be understood from a study of the following description and appended claims with reference to the attached drawings showing some preferred embodiments of the invention.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE PREFERRED EMBODIMENT

An embodiment of the present invention will hereinafter be described with reference to the drawings.

[1] Substrate (Workpiece)

Figure 1A:
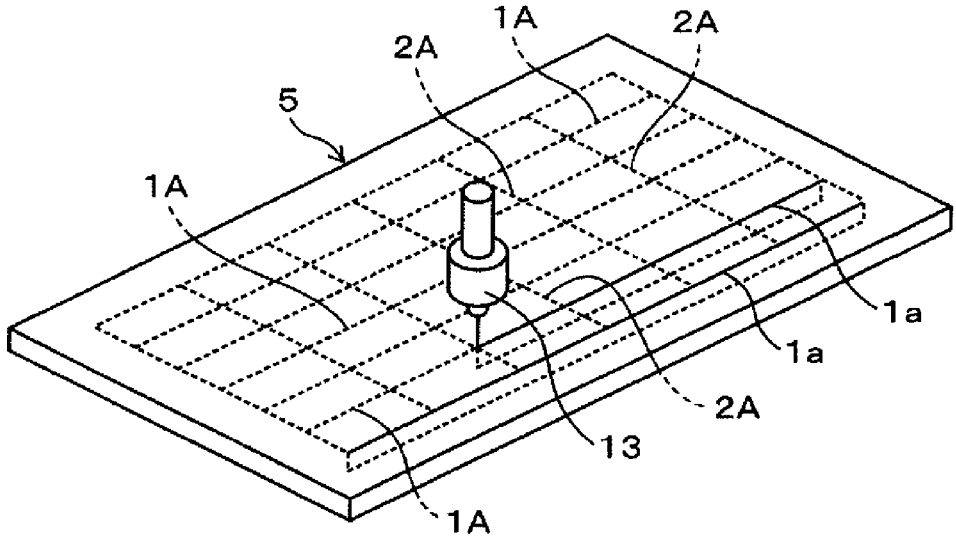
FIG. 1A is a perspective view of a substrate in a state where a first predetermined cutting line is being cut by a processing method of the present invention.
Figure 1B:
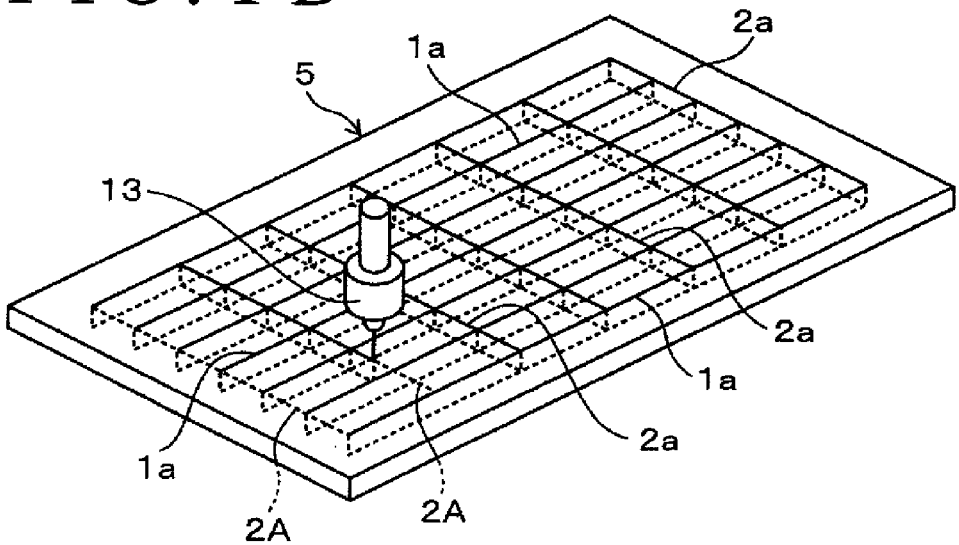
FIG. 1B is a perspective view of the substrate in a state where a second predetermined cutting line is being cut.

There is shown in FIGS. 1A and 1B a rectangular substrate 5 made of a brittle material such as glass epoxy or the like. This substrate 5 is used as a material for a mounting board mounted thereon with e.g. a semiconductor device and has an appropriate thickness. Referring to FIG. 1A, the substrate 5 is formed on a front surface with a plurality of first predetermined cutting lines 1A that longitudinally extend and with a plurality of second predetermined cutting lines 2A that extend perpendicularly to the first predetermined cutting lines 1A. The first predetermined cutting lines 1A as well as the second predetermined cutting lines 1B are formed parallel to each other and equally spaced apart from each other. Both ends of each of the first and second predetermined cutting lines 1A, 2A do not terminate at the corresponding edges of the substrate 5, that is, are located at corresponding positions close to the associated edges thereof. Rectangular areas sectioned by the cutting lines 1A, 2A are divided along the cutting lines 1A, 2A into individual mounting substrates or the like.

FIG. 1A illustrates a state where the first predetermined cutting lines 1A are cut with water jet emitted from a nozzle 13. FIG. 1B illustrates a state where the second predetermined cutting lines 2A are cut with water jet emitted from the nozzle 13. Next, a description is below given of a water jet processing machine suitable to cut the substrate 5 with water jet as described above by way of example.

[2] Configuration of Water Jet Processing Machine

Figure 2:
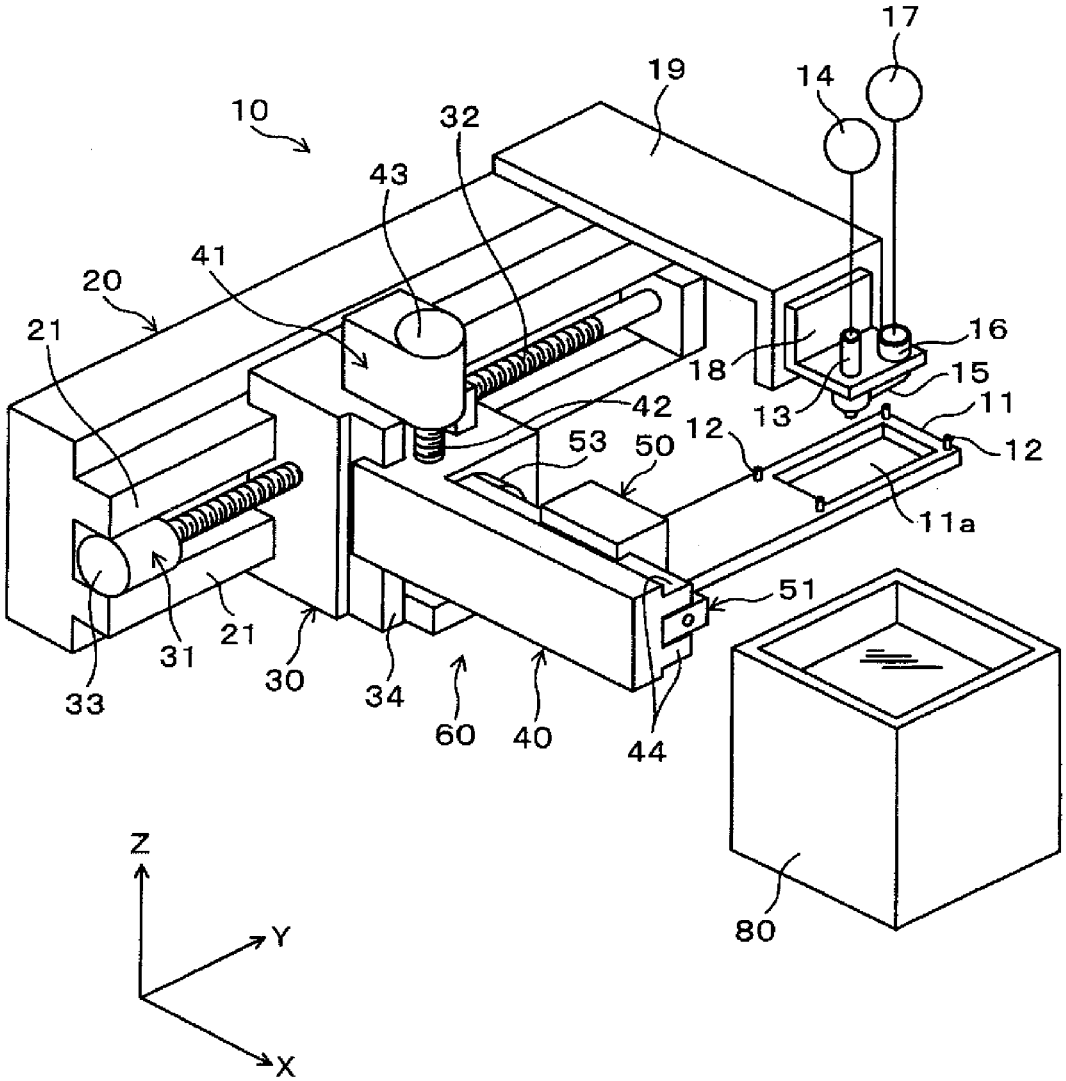
FIG. 2 is a perspective view of a water jet processing machine according to an embodiment of the present invention.

FIG. 2 illustrates the whole of a water jet processing machine 10 according to an embodiment. The machine 10 is such that the substrate 5 is held on a holding table (holding means) adapted to be movable in X-, Y- and Z-directions and subjected to cutting by water jet, high-pressure processing water, emitted generally perpendicularly to the front surface of the substrate 5 from a nozzle 13. The processing water used is e.g. water mixed with proper abrasive grains. Examples of the abrasive grains include metallic oxide grains such as alumina or the like.

The holding table 11 is mounted to a rectangular parallelepipedic stationary base 20 extending in the Y-direction via an X-Y-Z moving mechanism 60 (jet position moving means), which is composed of a Y-axial movable base 30, a Z-axial movable base 40 and an X-axial movable base 50. The stationary base 20 is formed on a lateral surface with a pair of guide rails 21 which extend in the longitudinal direction (the Y-direction). The Y-axial movable base 30 is mounted to the guide rails 21 so as to be slidable in the Y-direction.

The Y-axial movable base 30 is moved in the Y-direction along the guide rails 21 by the Y-axial moving mechanism 31. The Y-axial moving mechanism 31 is disposed between the guide rails 21 and includes a thread rod 32 turnably supported by the stationary base 20 to extend in the Y-direction and a pulse motor 33 adapted to normally and reversely turn the thread rod 32. The thread rod 32 is threadedly engaged with and is passed through the Y-axial movable base 30. In addition, the thread rod 32 is turnable but axially immovable. When the pulse motor 33 of the Y-axial moving mechanism 31 is actuated to turn the thread rod 32, the Y-axial movable base 30 moves along the guide rails 21 in the Y-direction in response to the turning direction.

The Z-axial movable base 40 is mounted to the Y-axial movable base 30 and the X-axial movable base 50 is mounted to the Z-axial movable base 40. Their mounting structures are the same as the mounting structure in which the Y-axial base 30 is mounted to the stationary base 20. Their moving mechanisms each have the same configuration as that of the Y-axial moving mechanism.

The Z-axial movable base 40 is slidably mounted to a pair of guide rails 34 formed on the Y-axial movable base 30 to extend in the Z-direction. In addition, the Z-axial movable base 40 is lifted and lowered along the guide rails 34 in the Z-direction by the Z-axial moving mechanism 41. The Z-axial moving mechanism 41 is turnably supported by the Y-axial movement base 30 and includes a Z-axially extending thread rod 42 threadedly engaged with and passed through the Z-axial movable base 40 and a pulse motor 43 adapted to normally and reversely turn the thread rod 42. When the thread rod 42 is turned by the pulse motor 43, the Z-axial movable base 40 is moved (lifted or lowered) in the Z-direction in response to the turning direction thereof.

The X-axial movable base 50 is slidably mounted to a pair of guide rails 44 formed on the Z-axial movable base 40 to extend in the X-direction and is moved along the guide rails 44 in the X-direction by the X-axial moving mechanism 51. The X-axial moving mechanism 51 is turnably supported by the Z-axial movable base 40 and includes a thread rod (not shown) threadedly engaged with and passed through the X-axial movable base 50 and extending in the Y-direction and a pulse motor 53 adapted to normally and reversely turn the thread rod. When the thread rod is turned by the pulse motor 53, the X-axial movable base 50 is moved in the X-direction in response to the turning direction.

The Y-axially extending flat-platelike holding table 11 is attached to a surface of the X-axial movable base 50 opposite to the side mounted to the Z-axial movable base 40. A Y-axially elongate rectangular attachment opening 11*a* is opened at the leading end side of the holding table 11. Upwardly projecting positioning pins 12 are provided on the periphery of the attachment opening 11*a* at respective positions corresponding to the four corners thereof. The substrate 5 is positioned on the holding table 11 using the positioning pins 12. The substrate 5 is moved in the X-, Y- or Z-direction along with the holding table 11 by the X-Y-X moving mechanism 60. The substrate 5 is positioned using a jig, not shown, adapted to hold the substrate 5 and removably attached to the positioning pins 12.

The nozzle 13 is disposed above the holding table 11 so as to orient the emitting direction of water jet vertically downward. The nozzle 13 is connected to processing water supplying means 14, from which high-pressure processing water is supplied to the nozzle 13. The water jet is emitted from the nozzle 13 toward the substrate 5 held by the holding table 11. A duct 15 is arranged on the periphery of the nozzle 13 so as to open toward the holding table 11 in a horizontally elongate dome-shape. A duct pipe 16 is disposed in the duct 15 to be juxtaposed to the nozzle 13. Suction means 17 is connected to the duct pipe 16. The suction means 17 sucks mist-like processing water resulting from circumferentially diffusing water jet, from the duct 15 via the duct pipe 16. The nozzle 13 and the duct 15 are secured to the stationary base 20 via a bracket 18 and via a nozzle support arm 19.

The holding table 11 is moved in the X-, and Y-directions by the operation of the X-axial moving mechanism 51 and the Y-axial moving mechanism 31, respectively. In this way, the emitting position of water jet from the nozzle 13 is moved with respect to the substrate 5 held by the holding table 11. In addition, the holding table 11 is lifted or lowered in the Z-direction by the operation of the Z-axial moving mechanism 41. In this way, the emitting distance of water jet from the nozzle 13 is adjusted with respect to the substrate 5 held on the holding table 11.

A buffer tank 80 is disposed below the holding table 11 to catch water jet emitted from the nozzle 13. The buffer tank 80 stores therein water adapted to reduce the force of water jet. The water in the buffer tank 80 is constantly regulated to a constant quantity by being drained by draining means not shown.

[3] Cutting of the Substrate by the Water Jet Processing Machine

The water jet processing machine 10 is configured as described above. Subsequently, a description is given of a method of cutting and dividing the substrate 5 using the machine 10. The substrate 5 is set on the holding table 11 by means of the jig mentioned above in such a manner that the longitudinal direction of the substrate 5 is parallel to the longitudinal direction of the attachment opening 11*a*.

(1) First Cutting Step

In a first cutting step, all the first predetermined cutting lines 1A of the substrate 5 are cut. The first predetermined cutting lines 1A extend in the Y-direction with the substrate 5 set on the holding table 11. The holding table 11 is moved in the Y-direction at a constant speed (the first speed) via the Y-axial movable base 30 of the X-Y-Z moving mechanism 60 while water jet is emitted from the nozzle 13 toward the first predetermined cutting line 1A. Thus, the water jet is passed through the substrate along the first predetermined cutting line 1A to form a first cut line 1*a*.

The water jet that has been passed through the substrate 5 collides with the water in the buffer tank 80 to reduce the force of the water jet. The emission-distance of water jet from the nozzle 13 to the substrate 5 is constant. The emission-distance is adjusted to an arbitrary value (e.g. about 3 mm) by lifting or lowering the Z-axial movable base 40.

The first cut line 1*a* is formed as below. The target of the nozzle 13 is aligned with one end of the first predetermined cutting line 1*a* and water jet is emitted thereto. The holding table 11 is moved therefrom, i.e., from such a starting point, in the Y-direction at the first speed. When the other end, i.e., a terminal, is reached, the emission of water jet is suspended. In this way, one of the first cut lines 1*a* is formed. Next, the X-axial movable base 50 is moved to a position corresponding to the next first predetermined cutting line 1A. The target of the nozzle 13 is aligned with one end of such a next first predetermined cutting line 1A. Water jet is emitted again while the holding table 11 is moved this time in the revere Y-direction at a constant speed (the first speed). In this way, such a next first predetermined cutting line 1A is cut to form a first cut line 1*a*. Such operation is repeated to cut all the first predetermined cutting lines 1A to form a plurality of the first cut lines 1*a*.

(2) Second Cutting Step

In a second cutting step, all the second predetermined cutting lines 2A extending in the X-direction are cut to form second cut lines 2*a*. The second predetermined cutting lines 2A are cut in the X-direction instead of the Y-direction in the same cutting procedure as the first predetermined cutting lines 1A. The second cut line 2*a* intersects in a cross shape the first cut lines 1*a* that have already been cut. The holding table 11 is moved at the same speed (the first speed) as when the first cut line 1*a* is formed, except for a predetermined short section adjacent to or anteroposterior to the intersection. The formation speed for the second cut line 2, i.e., the X-directional travel speed of the holding table 11 is set at a second speed lower than the first speed in the predetermined section or portion intersecting the first cut line 1*a*.

Figure 3A:
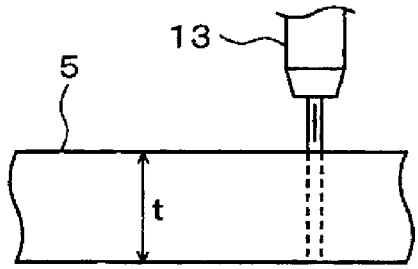
FIGS. 3A to 3D are cross-sectional views illustrating processes for forming a second cut line intersecting a first cut line by a method according to an embodiment of the present invention.
Figure 3B:
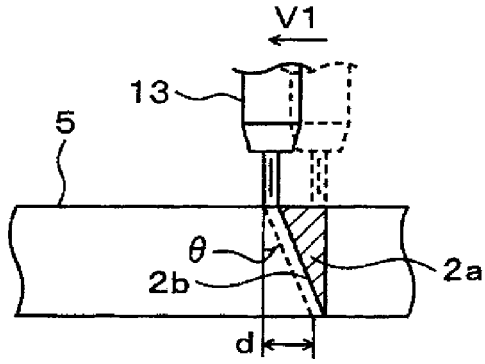
Figure 3C:
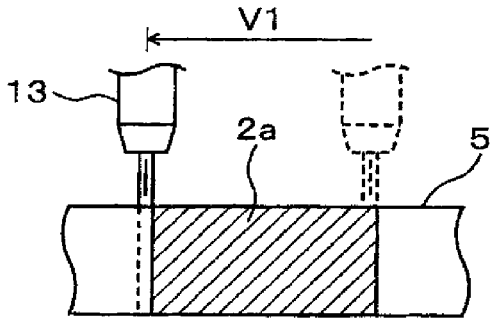

Principles and procedures encountered when the second cut line 2*a* is formed are described in detail with reference to FIGS. 3A through 3D. FIGS. 3A and 3B illustrate a state where while the nozzle 13 is moved in the X-direction (the left direction in the figures), water jet is emitted from the nozzle 13 onto the substrate 5 to form the second cut line 2*a*. FIG. 3C illustrates a state where a second cut line 2*a* is subsequently formed. Although the holding table 11 is moved in the water jet processing machine 10, a clear description is given assuming that only the nozzle 13 is moved.

The time S taken for the water jet directed to the front surface of the substrate 5 to reach the back surface thereof depends on conditions: the material and thickness t of the substrate 5, the pressure of the water jet, and the diameter and quantity of the abrasive grains mixed with water. If the nozzle 13 is moved while water jet is emitted, it is moved by distance d during the time S as shown in FIG. 3B. The distance d depends on the travel speed v1 of the nozzle 13 and the time S.

Figure 3D:
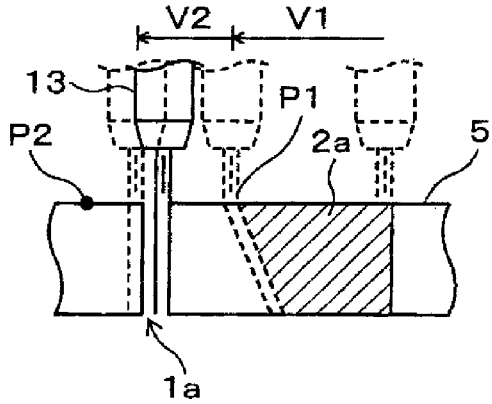

In short, d=v1×S. The longer the time S, or the greater the travel speed v1, the more an angle θ of delay-inclination, i.e., the degree of delay-inclination is increased. The delay inclination is formed by the front edge (an oblique line formed by a position of the substrate surface on which the water jet impinges and a position of the rear surface where the water jet is passed through) 2*b* of the second cut line 2*a*. The problem resulting from the occurrence of the delay-inclination is as described earlier. In the present embodiment, as shown in FIG. 3D, the nozzle 13 is moved at the first speed v1 until it reaches a position p1 immediately anterior to the first cut line 1*a*. The nozzle 13 is moved at a second speed v2 (e.g. about ⅕ to 1/20 of v1, preferably, about 1/10 of v1) lower than the first speed v1 as described above in the section from the position p1 to a position p2 immediately posterior to the traverse of the first cut line 1*a*. The distance between the position p1 which is a deceleration start position and the first cut line 1*a* is set to a distance exceeding at least the distance d in view of preventing the occurrence of an insufficient processing area. In addition, the second speed v2 is set to a speed in excess of 0 and lower than the first speed v1 according to the deceleration start position p.

After the nozzle 13 reaches the position P2, it is moved again at the first speed v1 to the position p1 immediately anterior to a first cut line 1*a* the nozzle 13 next intersects. Then, the nozzle 13 is moved at the second speed in the section p1 to p2 anteroposterior to the next intersection. Such speed control is repeated.

As described above, the water jet is emitted from the nozzle 13 that is moved in the section p1 to p2 anteroposterior to the intersection of the second cut line 2*a* with the first cut line 1*a* at a travel speed lower than in the other major section. This provides the following function.

Figure 7:
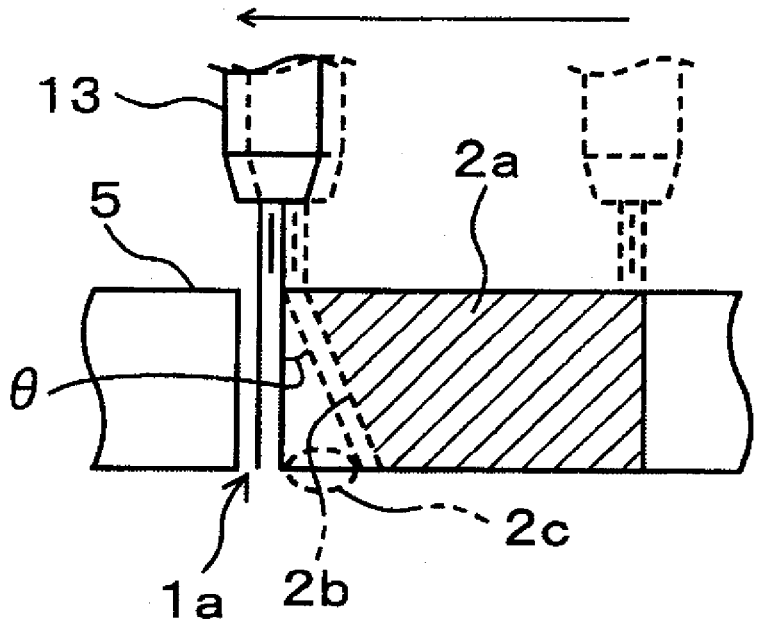
FIG. 7 PRIOR ART
FIG. 7 is a cross-sectional view for assistance in explaining the occurrence principles of an insufficient processing area.
Figure 8A:
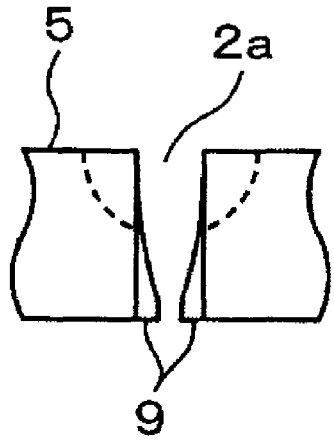
FIG. 8A PRIOR ART
FIG. 8A is a front view illustrating abnormal processing such as a projection occurring at an insufficient processing area as viewed from the direction opposed to the advancing direction of the second cut line.
Figure 8B:
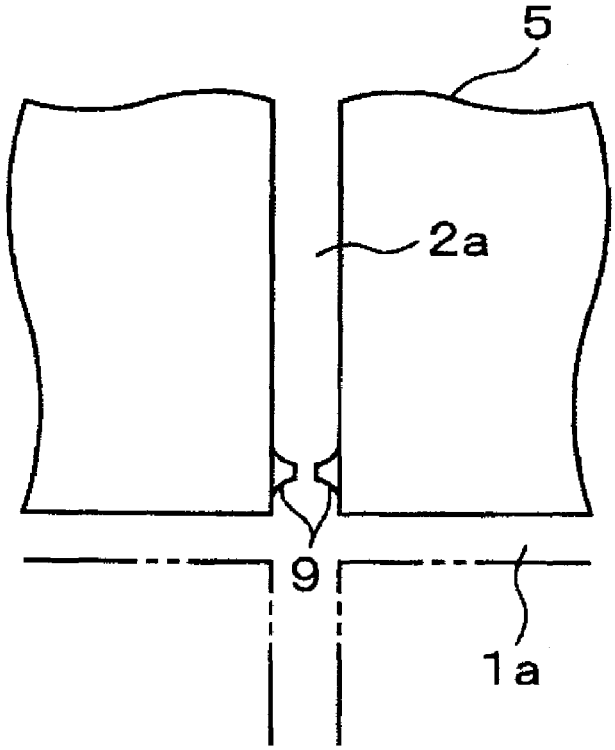
FIG. 8B PRIOR ART
FIG. 8B is a rear view of the insufficient processing area.

First, the nozzle 13 is decelerated to the second speed v2 from the position p1 anterior to the intersection of the second cut line 2*a* with the first cut line 1*a*. The angle θ of delay-inclination becomes a near zero (0) angle. A phenomenon called "the escape of jet water" mentioned earlier is unlikely to occur. The insufficient processing area 2*c* shown in FIG. 7 can be reduced or the occurrence of the insufficient processing area 2*c* can be prevented depending on the speed. Thus, the projections 9 shown in FIGS. 8A and 8B will not occur.

Figure 6A:
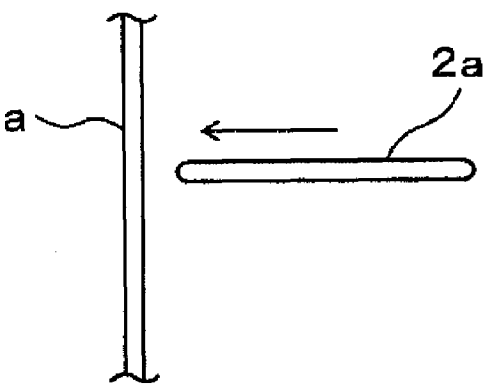
FIG. 6A PRIOR ART
FIGS. 6A, 6B and 6C illustrate processes for forming the second cut line crisscross intersecting the first cut line.
Figure 6B:
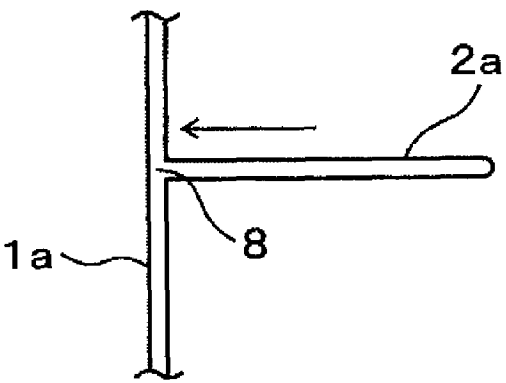
FIG. 6B PRIOR ART
Figure 6C:
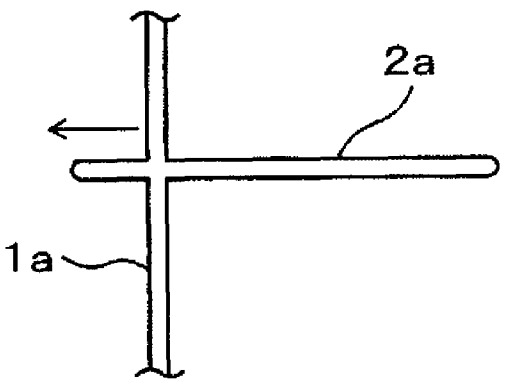
FIG. 6C PRIOR ART

Next, the water jet traverses the first cut line 1*a* still at the second speed v2 to form the second cut line 2*a* to the position p2, that is, intersects the first line 1*a* in a cross shape. At this time, the water jet does not collide with a wall (a portion indicated with reference numeral 8 in FIG. 6B) of the substrate 5 but slowly hits and gradually carves the wall to form the second cut line 2*a*. If the travel speed of the water jet remains unchanged at the first speed v1, the water jet collides with the wall and the processing water bounces off the wall and hits the periphery (a portion surrounded by a broken line of FIG. 8A) of an opening of the second cut line 2*a* to the first cut line 1*a*, causing damage in some cases. However, since the speed encountered when the water jet traverses the first cut line 1*a* and hits the wall is as low as the second speed v2, the bounce of the processing water is unlikely to occur. Consequently, it is avoided that the periphery of the opening of the second cut line 2*a* to the first cut line 1*a* is damaged by the bounce of the processing water.

Incidentally, the second cut line 2*a* does not traverse the outermost first cut line 1*a* but comes into a T-shaped intersection therewith. In this case, the nozzle 13 is moved at the second speed from a position spaced by the distance p1 from the first cut line 1*a*. When the second cut line 2*a* reaches the first cut line 1*a*, the emission of the water jet is suspended.

As described above, when the second cut line 2*a* is formed by intersecting the first cut line 1*a*, the travel speed of the nozzle 13 is made relatively low in the section p1 to p2 anteroposterior to such an intersection. Thus, it is possible to prevent damage or abnormal processing in which an insufficient processing area is produced to form projections or processing water is bounced to cause damage. As a result, a plurality of individual mounting substrates can be obtained as satisfactory products.

In the embodiment described above, when the nozzle 13 reaches the deceleration position p1, it may be stopped once at the position p1. The angle θ of the delay-inclination is eliminated by stopping the nozzle 13 once like this and continuing emitting water jet. As a result, it is more ensured to provide an effect of preventing the occurrence of an insufficient processing area compared with the case where the nozzle 13 is moved at a low speed with the delay-inclination left without one-stop.

Next, an effect of the present invention is exemplified by exhibiting a working example of the present invention.

WORKING EXAMPLE

A glass epoxy plate with a thickness of 3 mm is cut in a cross shape by the same water jet processing machine as that illustrated in FIG. 2. Initially, a first predetermined cutting line to be cut first was cut by water jet emitted from a nozzle at a relative travel speed of 35 mm/sec. Incidentally, it was grasped that an angle θ of delay-inclination occurring at this time as shown in FIG. 3B was about 14.5° and the distance d is about 0.8 mm. Next, a second predetermined cutting line crisscross intersects the first cut lines thus formed was cut at 35 mm/sec at a portion thereof immediately anterior to the intersection. When a position to within 0.9 mm of the first cut line is reached, the relative travel speed of the nozzle is decelerated to 3 mm/sec and the intersection is traversed to form a second cut line.

COMPARATIVE EXAMPLE

A second cut line is made to intersect first cut lines in the same procedures as the working example except that the second cut line was made to traverse the intersection at a constant speed of 10.0 mm/sec unlike the working example without the deceleration of the second cut line immediately anterior to the intersection with the first cut line.

Figure 4A:
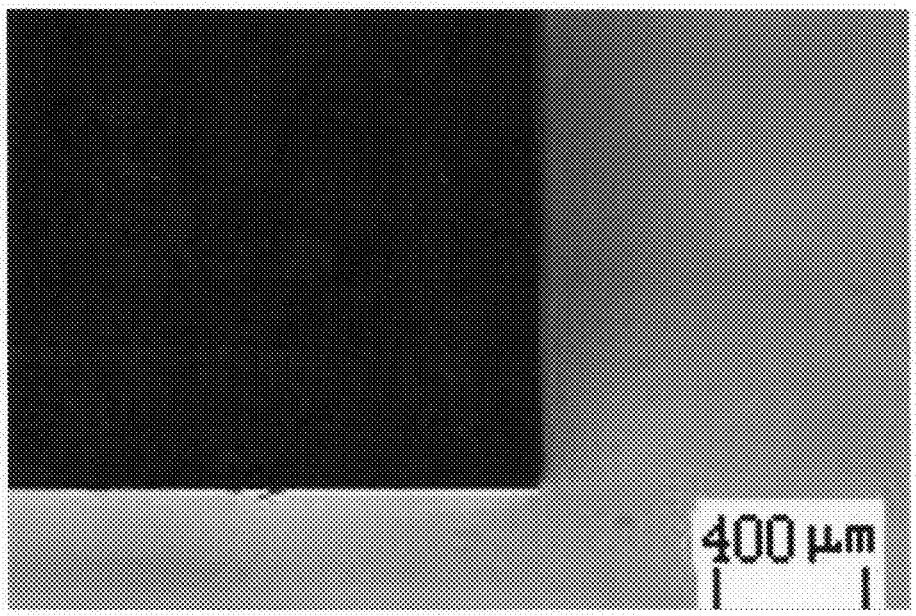
FIG. 4A is a photograph showing a material cut by the method of the present invention as viewed from the direction opposed to the advancing direction of the second cut line.
Figure 4B:
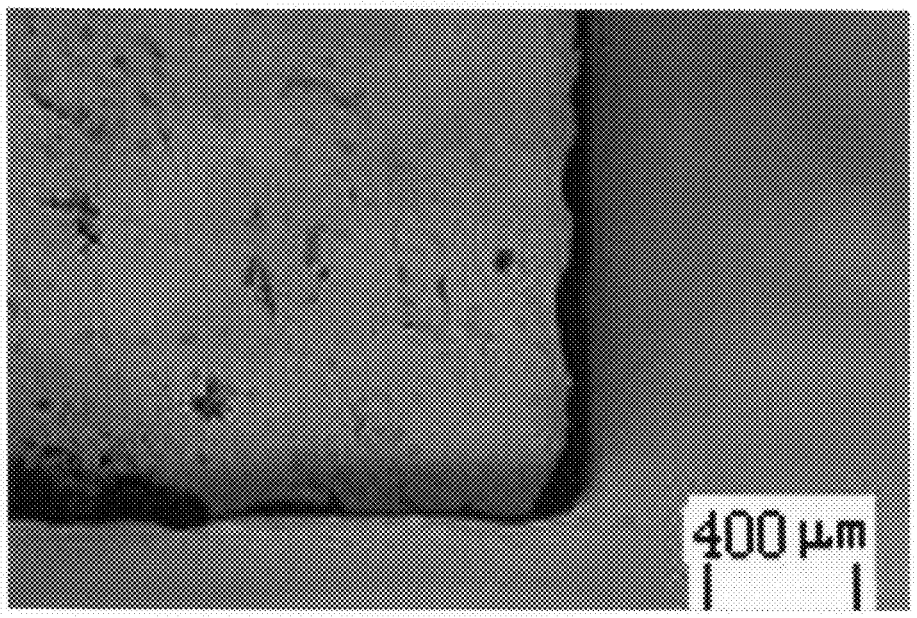
FIG. 4B is a photograph showing the back of the material in FIG. 4A.

The periphery of the intersection of the second cut line with the first cut line was observed to check each of the cut states of the above-example and comparative example. FIG. 4A is a photograph showing a cut material in the working example as viewed from the direction opposed to the advancing direction of the second cut line and FIG. 4B is a photograph sowing the back of the cut material in FIG. 4A. As shown in FIG. 4A, a wall portion formed along the second cut line so as to be immediately anterior to the intersection (the corner in the photograph) is vertically linear and flat. In addition, as shown in FIG. 4B, no projection occurs on the wall portion formed along the second cut line and near the intersection.

Figure 5A:
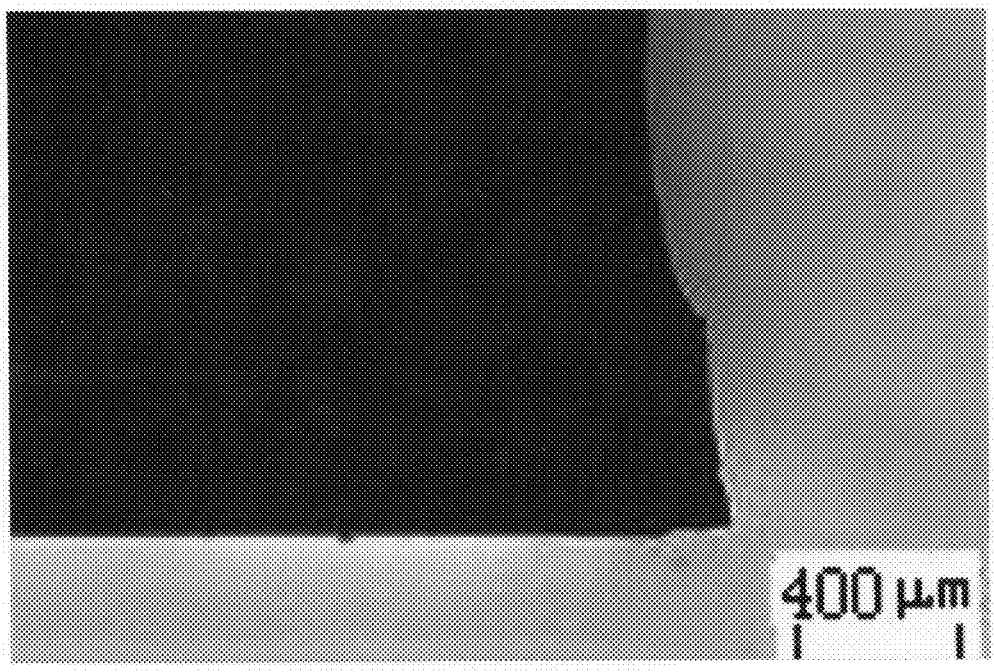
FIG. 5A is a photograph showing a material cut by the method of a relative example as viewed from the direction opposed to the advancing direction of the second cut line.
Figure 5B:
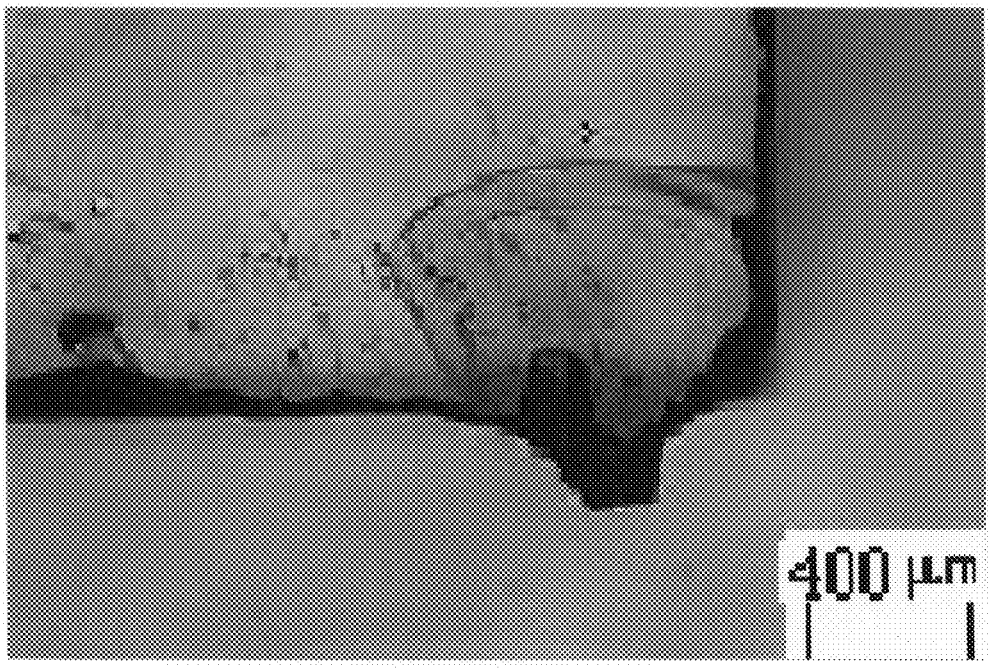
FIG. 5B is a photograph showing the back of the material.

In contrast, in the comparative example shown in FIGS. 5A and 5B, a downward projection occurs on the wall portion formed along the second cut line and near the intersection. FIG. 5A is a photograph showing a cut material as viewed from the direction opposed to the advancing direction of the second cut line and FIG. 5B is a photograph showing the back of the cut material. In the comparative example, since the intersecting speed of the second cut line relative to the first cut line is relatively high, when the second cut line intersects the first cut line, the escape of water jet occurs, which produces an insufficient processing area.

The above-results proved that the occurrence of an insufficient processing area is prevented to provide a satisfactory cut surface by setting the intersection speed of the second cut line relative to the first cut line at a relatively low level.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A water jet processing method using a water jet processing machine including:

holding means for holding a platelike workpiece on which a first predetermined cutting line and a second predetermined cutting line intersecting the first predetermined cutting line are set;

processing water supplying means for supplying high-pressure processing water;

a nozzle adapted to emit the processing water supplied from the processing water supply means, to the workpiece held by the holding means; and emission-position moving means for relatively moving the nozzle and the holding means to change a position where the processing water is emitted from the nozzle to the workpiece;

wherein while the nozzle and the holding means are relatively moved by the emission-position moving means, the processing water emitted from the nozzle is directed to the workpiece held by the holding means along the first predetermined cutting line and along the second predetermined cutting line to cut the first and second predetermined cutting lines, the water jet processing method comprising:

a first cutting step for cutting the first predetermined cutting line to form a first cut line at a relative travel speed between the nozzle and the holding means set to a first speed; and a second cutting step for cutting the second predetermined cutting line to form a second cut line, the second predetermined cutting line being cut in a section anteroposterior to an intersection between the first cut line and the second predetermined cutting line at the relative travel speed set to a second speed lower than the first speed.

2. The water jet processing method according to claim 1 wherein in the second cutting step relative movement between the nozzle and the holding means is once stopped when water jet enters and cuts the anteroposterior section at the second speed.

* * * * *